US005738206A

United States Patent [19]

Souza

[11] Patent Number: 5,738,206

[45] Date of Patent: Apr. 14, 1998

[54] CHILD RESISTANT SWITCH LOCK

[75] Inventor: Michael A. Souza, Fall River, Mass.

[73] Assignee: Leviton Manufacturing Co., Inc., Little Neck, N.Y.

[21] Appl. No.: 840,319

[22] Filed: Apr. 16, 1997

[51] Int. Cl.[6] ..... H01H 3/20

[52] U.S. Cl. ..... 200/43.16; 200/43.01; 200/322; 200/330

[58] Field of Search ..... 200/43.16, 43.19, 200/43.11, 43.01, 322, 327, 330, 547, 548

[56] References Cited

U.S. PATENT DOCUMENTS

| | | | |
|---|---|---|---|
| 3,170,050 | 2/1965 | Buturuga | 200/43.19 |
| 4,882,458 | 11/1989 | Berg et al. | 200/43.16 X |
| 4,914,265 | 4/1990 | Mongeau | 200/330 |
| 5,021,616 | 6/1991 | Hardt | 200/43.16 |
| 5,577,602 | 11/1996 | Connor et al. | 200/330 X |

*Primary Examiner*—Renee S. Luebke
*Attorney, Agent, or Firm*—Paul J. Sutton

[57] ABSTRACT

A child resistant switch lock having a body and a slide which can be installed over an existing mounted toggle-type or rocker-type switch. The slide is arranged to operate the toggle handle or rocker between an on and off positions. Stopping tabs on the body prevent movement of the slide from the off to the on positions unless the stopping tabs are first depressed. The required two handed operation, one to depress the stopping tabs and one to advance the slide, make operation by a child very difficult. The slide can operate the toggle handle of a toggle-type switch directly or the rocker of the rocker-type switch through intermediate cams contained in the body.

18 Claims, 6 Drawing Sheets

CHILD RESISTANT SWITCH LOCK

BACKGROUND OF THE INVENTION

1. Field of the Invention

The invention is directed to electrical switches for turning on and off electrically powered devices and more particularly to a locking device which can prevent a child from turning on an electrically powered device and thus prevent injury to the child or others or damage to property.

2. Description of the Prior Art

Known prior art devices to prevent a child turning on an electrically operated device when no one is present to supervise such child involve the use of a cage or other enclosure-type device which surrounds the entire switch and is locked in position with a key-lock arrangement. A base is fixed to the wall, ceiling, mounting surface etc. in which the switch is mounted fully surrounding such switch. A metal cage or transparent cover is then fit to and locked to the base. The arrangement is large, expensive and not very attractive. Although widely used in industry and sports, such arrangements are generally not employed in the home.

The above-described devices and those that use a special switch plate which accepts a locking mechanism, in addition to being large, also require a key, which if lost makes removing the locking device difficult.

SUMMARY OF THE INVENTION

The instant invention overcomes the difficulties noted above with respect to the prior art. This is accomplished by adding a locking mechanism over an already installed electrical switch which is just slightly smaller than the switch plate of the installed switch. The locking mechanism consists of a body member placed over the switch plate of the already installed electrical switch and fastened to the gang box to which the installed switch is mounted and using the mounting screws provided. A slide member moves over portions of the front of the body member generally between the top and bottom edges of the body member. A recess in the slide member receives the toggle handle of a toggle switch and employing internal cams operates the toggle handle to the "on" position when moved in a first direction and to the "off" position when moved in the opposite direction.

The body member also contains a pair of rocker switch cams which can operate a rocker switch over which the body member is placed. Actuator cams operate the rocker switch cams also based upon the direction of travel of the slide member.

The body member contains at least one slide member stopping tab which is retained below the level of the slide member when the slide member moves in a first direction to render the stopping tab inactive. Movement of the slide member in the second direction releases the at least one stopping tab which engages an end surface of the slide member to prevent its movement in the first direction again. The stopping tabs may then be depressed to permit the slide member to again go in the first direction. It is an object of the instant invention to provide a novel switch lock.

It is an object of the instant invention to provide a novel child resistant switch lock.

It is another object of the instant invention to provide a novel child resistant switch lock which can be easily operated by an adult.

It is yet another object of the instant invention to provide a novel switch lock which can be installed over an installed electrical switch without disrupting its functioning.

It is still another object of the instant invention to provide a novel switch lock which is approximately the same size as an electrical switch plate and which can be installed over an installed electrical switch without interfering with the operation of switch over which the switch lock is applied.

Other objects and features of the invention will be pointed out in the following description and claims and illustrated in the accompanying drawings, which disclose, by way of example, the principles of the invention, and the best mode which is presently contemplated for carrying them out.

BRIEF DESCRIPTION OF THE DRAWINGS

In the drawings in which similar elements are given similar reference characters.

DESCRIPTION OF THE PREFERRED EMBODIMENTS

Figure 1:
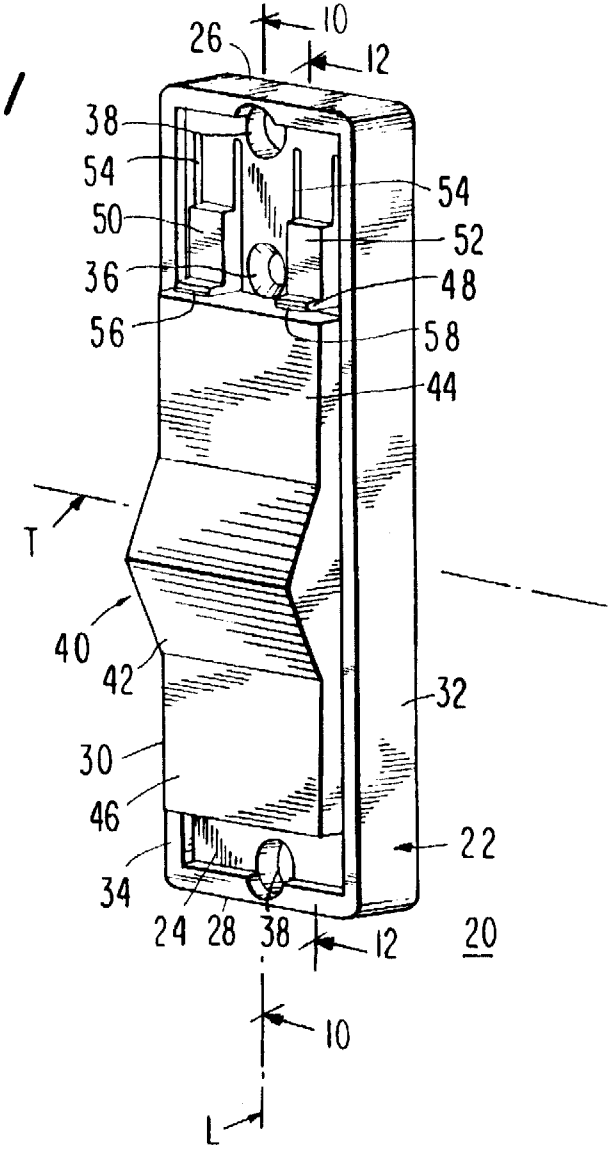
FIG. 1 is a front lower right perspective view of a child resistant switch lock constructed in accordance with the concepts of the invention.

Turning now to FIG. 1, there is shown a child resistant switch lock 20 constructed in accordance with the concepts of the invention. Child resistant switch lock 20 has a base member 22, having a top wall 26, a bottom wall 28 and two parallel, spaced apart side walls 30, 32. The corners of base member 22 are rounded and a rib 34 extends about the entire front face 24 of body member 22. Two first mounting apertures 36 (only one of which is visible in FIG. 1) are positioned along the central longitudinal axis "L" of base member 22 and spaced a first distance from the central transverse axis "T" of base member 22. A second set of two mounting apertures 38 are spaced along longitudinal axis L and spaced a second, greater distance from the central transverse axis T. A slide member 40 has a generally triangular central section 42 flanked by two raised flat sections 44 and 46. Raised flat section 44 has a leading edge 48. Body member 22 has two deflectable stopping tabs 50 and 52 defined by slots 54 in front face 24. The resiliency of the body member 22, which may be fabricated from a suitable insulating material such as thermo-set or thermoplastic plastic materials, and the presence of the slots 54 permit the stopping tabs 50 and 52 to be deflected downwardly below the surface of front face 24 as will be described below. Stopping tabs 50 and 52 have stop faces 56, 58, respectively, to engage the leading edge 48 and prevent movement of the slide member 40 from the position shown in FIG. 1.

Figure 3:
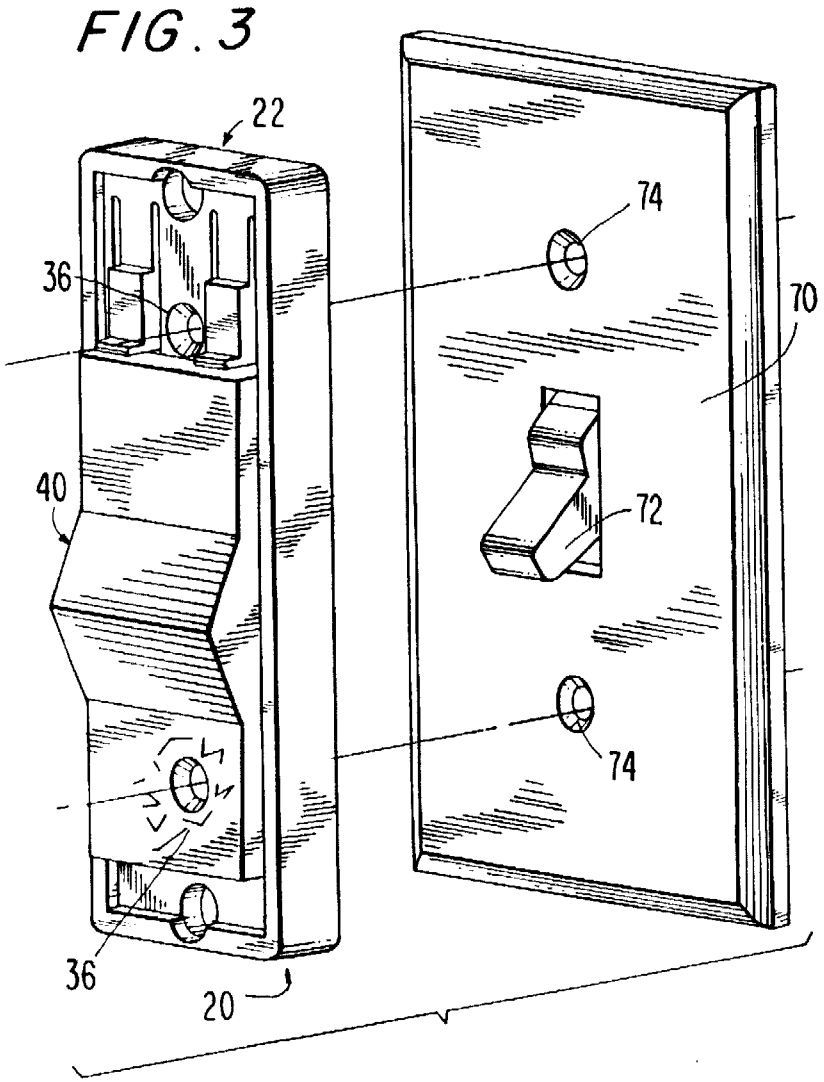
FIG. 3 is an exploded lower right perspective view of the device of FIG. 1 applied over a toggle handle electrical switch.

Turning now to FIG. 3, there is shown the mounting of child resistant switch lock 20 over the toggle handle 72 of a toggle-type switch (not shown) mounted behind face plate 70. Face plate 70 has two apertures 74 which are aligned with two threaded apertures in the switch (not shown). Threaded fasteners (not shown) are placed through apertures 74 and made to engage the threaded apertures of the switch to assemble face plate 70 to the switch. The threaded fasteners are removed from the switch and face plate 70 and while the face plate 70 is held in position against the switch and surrounding wall, the base member 22 is placed over the face plate 70 with apertures 36 aligned with apertures 74. The threaded fasteners can now be inserted through apertures 36 and 74 to assemble the child resistant switch lock 20 over the face plate 70 and to the switch. The aperture 36 adjacent bottom wall 28 is accessible once the slide member 40 is moved toward top wall 26 and beyond the position shown in FIG. 1 once the stopping tabs 50, 52 have been depressed, as will be described below. Toggle-type switches are well known in the art and an example of one such switch can be found in U.S. Pat. No. 3,598,943 issued Aug. 10, 1971 to E. L. Barrett entitled "Actuator Assembly For Toggle Switch".

Figure 4:
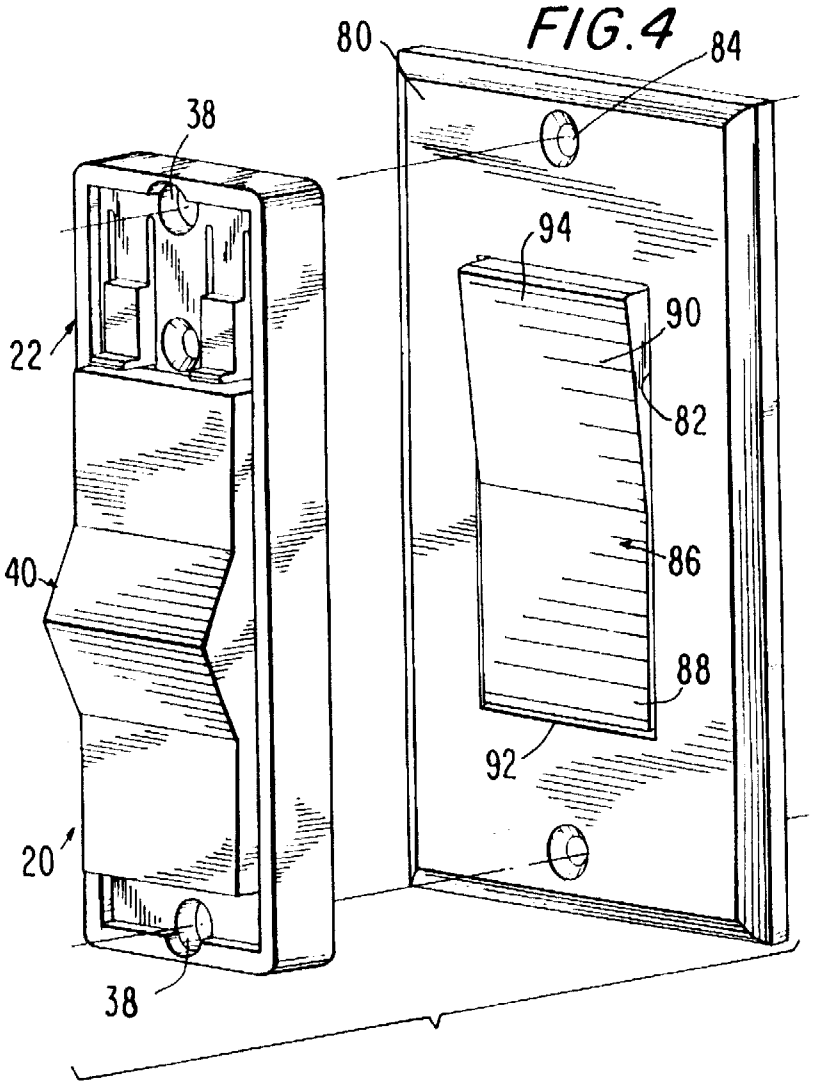
FIG. 4 is an exploded lower right perspective view of the device of FIG. 1 applied over a rocker-type electrical switch.

Referring to FIG. 4, the application of the child resistant switch lock 20 to a rocker-type switch is shown. Rocker switches are shown and described in U.S. Pat. No. 4,169,972 issued Oct. 2, 1979 to C. E. Black III et al. entitled "Electrical Switches with Rocker" and U.S. Pat. No. 5,382,768 issued Jan. 17, 1995 to Stephen R. Kurek et al. entitled "Rocker-Type Electrical Switch" and assigned to the assignee of the instant invention. The rocker-type switch (not shown) has a rocker element 86 which protrudes through an elongated slot 82 in a face plate 80. The switch is operated by depressing one or the other of the panels 88, 90 preferably near the free ends 92, 94, respectively. The face plate 80 is fastened to the switch by means of threaded fasteners (not shown) passing through apertures 84 into threaded apertures (not shown) in the switch.

Again, the threaded fasteners are removed and holding the face plate 80 in position the child resistant switch lock 20 is placed over the face plate 80 and the switch lock 20 and the face plate 80 are assembled to the switch by inserting the threaded fasteners through apertures 38 in switch lock 20, apertures 84 in face plate 80 and into threaded engagement with threaded apertures in the switch.

Figure 5:
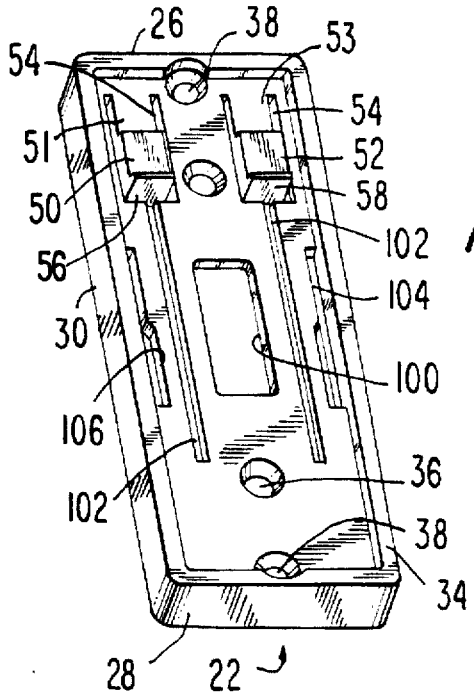
FIG. 5 is a top front left perspective view of the body member of the switch lock of FIG. 1.

Turning now to FIG. 5, the base member 22 of the child resistant switch lock 20 is shown. A central slot 100 permits the toggle handle 72 of a toggle-type switch to enter the central portion 42 of slide member 40. Two parallel elongate slots 102 extend from a position adjacent stop faces 56, 58 towards bottom wall 28. The slots 102 receive the rocker switch cams, as will be described below. Two further parallel elongate slots 104 extend parallel to side walls 30, 32 and receive the extended legs 112 of the slide member 40. Slots 104 are enlarged at their end adjacent the bottom wall 28. The enlargements 106 permit entry of a retainer rib 114 on the extended legs 112 of the slide member 40. As described above, stopping tabs 50, 52 are defined by slots 54 which extend on three sides, including the side adjacent slots 102. The stopping tabs 50, 52 have thinner sections 51, 53, respectively at their ends adjacent top wall 26. The thinner sections 51, 53 are as thick as the remainder of the top of body member 22 and much thinner than the main body of the stopping tabs 50, 52. As set out above, the stopping tabs 50, 52, because of the thinned sections 51, 53, respectively, their cantilever mounting and the material of which body member 22 is formed, permit the stopping tabs 50, 52 to be deflected below front face 48 of slide 40.

Figure 6:
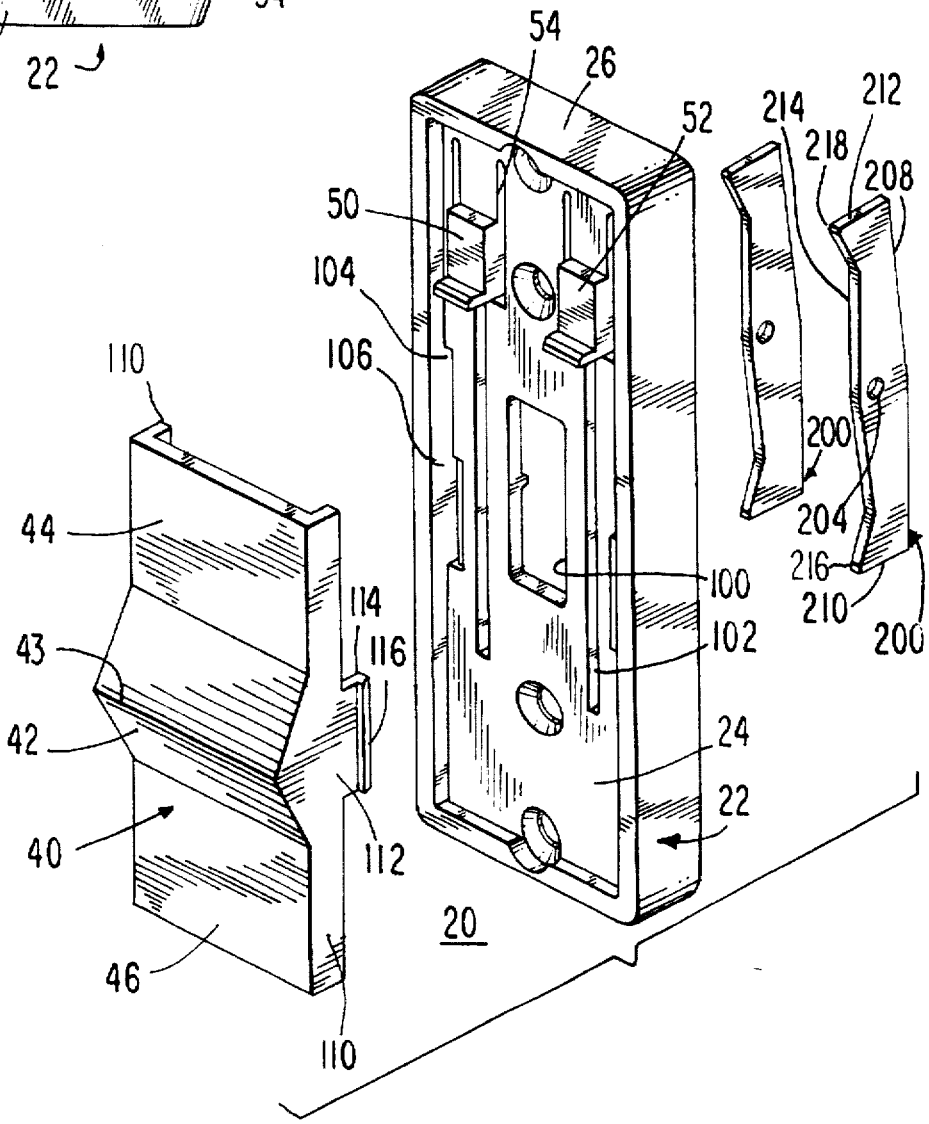
FIG. 6 is an exploded front upper right perspective view of the device of FIG. 1.

As is best seen in FIG. 6, the slide member 40 has two uniform height walls 110 running along the entire length of slide member 40. Flexible extended legs 112 extend from walls 110 within the length of the base of triangular central section 42. At the free end of the extended leg 112 on the outer surface thereof are located locking tabs 114 only one of which is shown in FIG. 6. The leading edges 116 are outwardly tapered. When the slide member 40 is assembled to body member 22, the leading edges 116 are made to engage the outward edges of slots 104 adjacent enlargements 106. The extended legs 112 are each forced into an associated enlargement 106 until the locking tabs 114 are below the rear face 25. At this time the extended legs 112 return to their initial position and place the locking tabs 114 under back surface 25 engaging such back surface 25 to retain slide member 40 on base member 22 while permitting the slide member 40 to move along the front surface 24.

Figure 7:
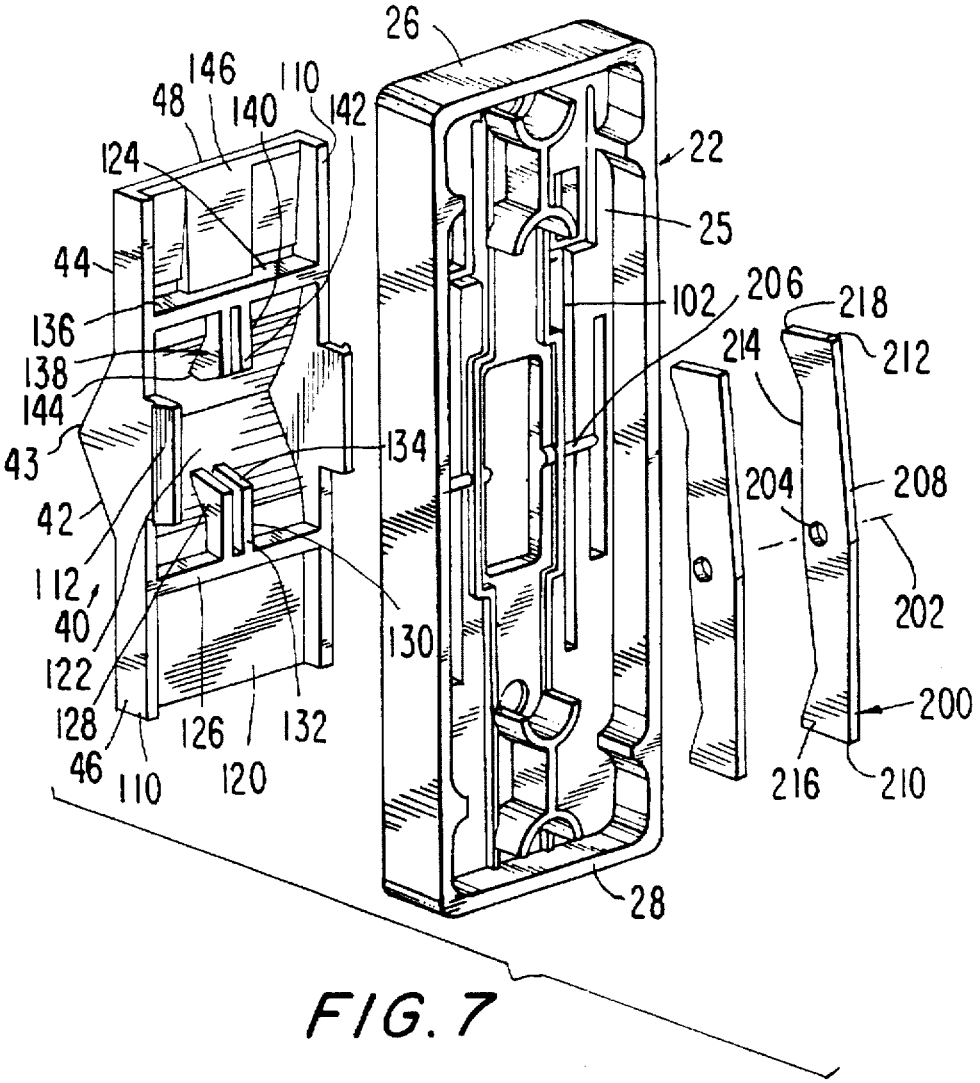
FIG. 7 is an exploded rear lower left perspective view of the device of FIG. 1.
Figure 10:
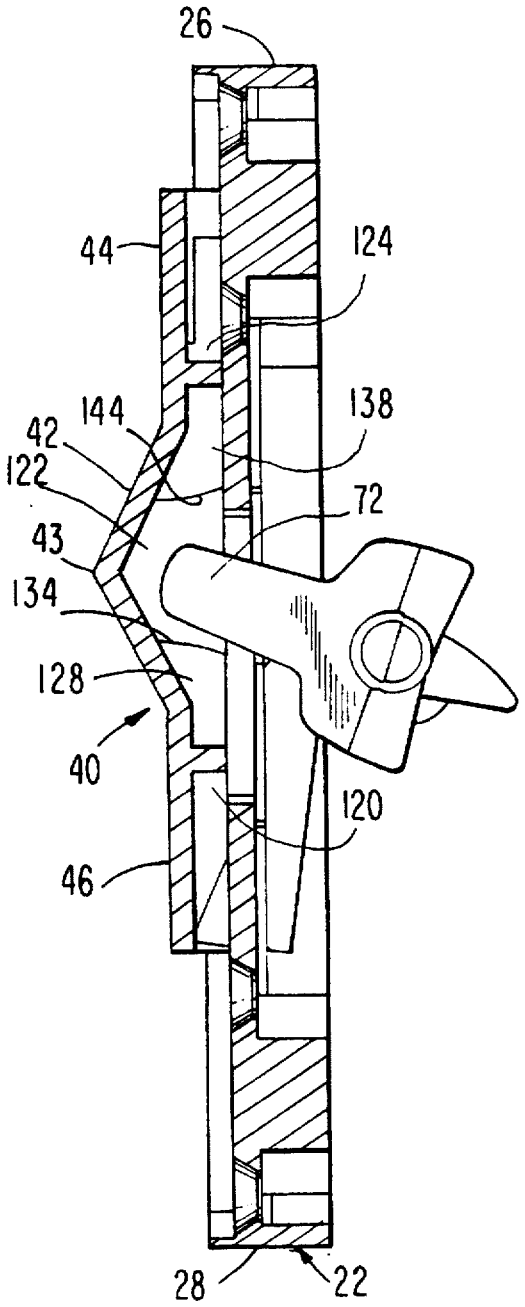
FIG. 10 is a side elevational view, partly in section, of the device of FIG. 1 taken along the lines 10—10 and showing a toggle handle and the slide in the "on" position.
Figure 11:
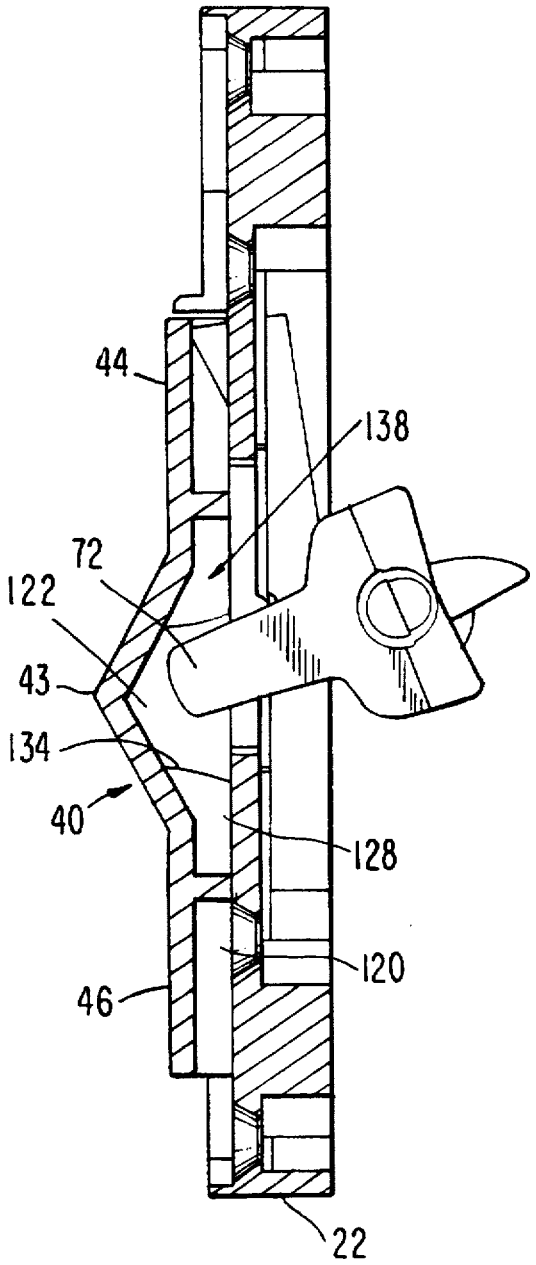
FIG. 11 is the same as FIG. 10, but with the toggle handle and the slide in the "off" position.

The interior of slide member 40 is best seen in FIG. 7 to which reference is now made. The interior of slide member 40 is substantially hollow through triangular central section 42 and flat sections 44 and 46. A rear cam actuator 126 extends across the interior 120 of flat section 46 close to its juncture with the interior cavity 122 of triangular central section 42 and between the walls 110 and parallel with transverse axis T. A rear toggle switch cam 128 made up of two spaced apart walls 130 parallel with longitudinal axis L extends from rear cam actuator 126 along the interior 120 and along the inside of cavity 122. The walls 130 have a bottom flat surface 132 generally parallel with the top surface of flat section 46 and leading surfaces 134 inclined inwardly towards the apex 43 as shown in FIGS. 10 and 11. A front cam actuator 136 extends across the interior 124 of flat section 44 close to its juncture with the interior cavity 122 of triangular central section 42 and between the walls 110 and parallel with transverse axis T. A front toggle switch cam 138 made up of two spaced apart walls 140 parallel with longitudinal axis L extends from front cam actuator 136 along the interior 124 and along the inside of cavity 122. The walls 140 have a bottom flat surface 142 generally parallel with the top surface of flat section 44 and leading surfaces 144 inclined inwardly towards the apex 43 as shown in FIGS. 10 and 11. The cavity 124 has a central raised rib 146 of uniform height from leading edge 48 to the front cam actuator 136. Flanking central raised rib 146 are two side raised ribs 148 which start out at the same height as central raised rib 146 adjacent leading edge 48 and decline in height as they advance towards front cam actuator 136 (see FIGS. 8 and 9). Side raised ribs 148 stop short of front cam actuator 136 to provide slots 150.

Figure 8:
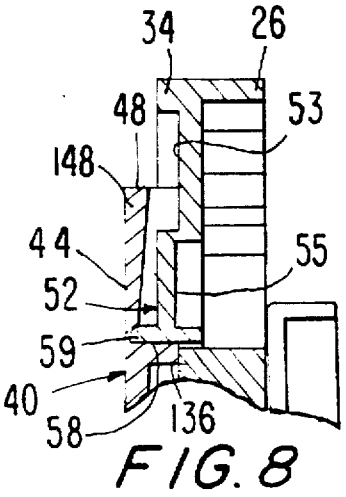
FIG. 8 is a fragmentary, side elevational view, partly in section, of a portion of the device of FIG. 1, with the slide in a first position.
Figure 9:
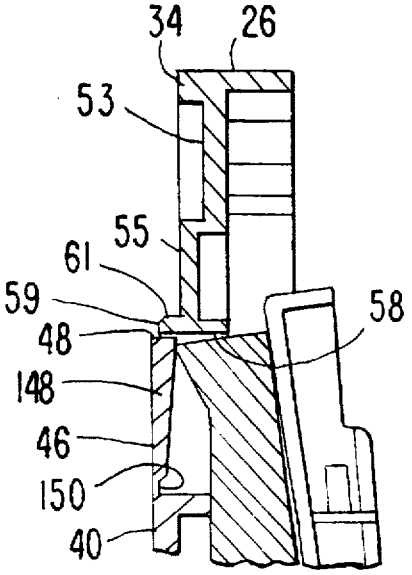
FIG. 9 is a fragmentary, side elevational view, partly in section, of the portion of the device of FIG. 1, shown in FIG. 8 with the slide in a second position.

Turning now to FIGS. 8 and 9, the operation of the stopping tabs 50 and 52 is set forth. With slide member 40 in the position where leading edge 48 is closest to top wall 26, the switch is considered to be in the "on" condition, that is, with power applied to some electrical device such as a lamp, an appliance or the like. The stop surface 58 is in contact with the front cam actuator 136 and the top portion 59 of stop surface 58 is in slot 150 which acts as a detent to prevent unwanted movement of slide member 40 towards bottom wall 28 (see FIG. 8). When a downward force, that is one towards bottom wall 28, is applied to triangular central section 42, the tapered surface 61 of top portion 59 moves out of slot 150 and along the tapered surface of raised rib 148 depressing fully the stopping tab 52. Once top portion 59 moves beyond the leading edge 48 of slide member 40, the stopping tab 52 is free to take the position shown in FIG. 9 with stop face 58 engaging leading edge 48 of slide member 40. This is the "off" position with slide member 40 in the position shown in FIG. 1. The slide member 40 cannot be moved upwardly towards top wall 26 because of the engagement of stop face 58 with leading edge 48. Although the description has been made in terms of one stopping tab 52, the operation of stopping tab 50 will be the same and will occur at the same time.

Any attempt to push slide member 40 towards top wall 26 to turn the switch on by merely pushing on the slide member 40 triangular central section 42 will be prevented by the engagement of the stop faces 56, 58 of stopping tabs 50, 52, respectively, with leading edge 48 of slide member 40. To advance the slide member 40 beyond this point it will be necessary to depress both tabs 50, 52 below the undersurface of raised ribs 148 and press upwardly on the surface of the triangular central section 42 closest to bottom wall 28. The slide member 40 will now move towards top wall 26 until the extended legs 112 engage the ends of slots 104. Because of the need to use one hand to depress the locking tabs 50, 52 and another hand to move the slide member 40, it has been found that most young children do not have the strength and coordination needed to operate the stopping tabs 50, 52 and the slide member 40 at the same time.

FIGS. 10 and 11 show the switch lock 20 employed with a toggle-type switch having a toggle handle 72 as is shown in FIG. 3. FIG. 10 shows the toggle switch handle 72 in the on condition. As the slide member 40 is moved to the on position, as shown in FIG. 10, the inclined leading surfaces 134 of rear toggle switch cam 128 engage the toggle handle 72, which is in the off position as shown in FIG. 11, and move the toggle handle 72 to the position shown in FIG. 10. When the toggle switch is to be returned to the off condition, as shown in FIG. 11, the leading surfaces 144 of front toggle switch cam 138 will engage the toggle handle 72 and move it from the position shown in FIG. 10 to that shown in FIG. 11. To return the toggle handle to the position shown in FIG. 10 from that shown in FIG. 11, the locking tabs 50 and 52 will have to be depressed while slide member 40 is moved, as described above.

Figure 2:
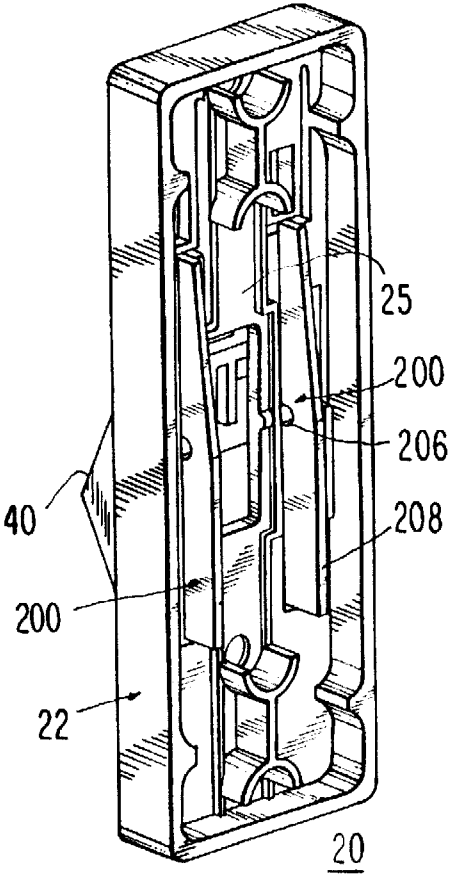
FIG. 2 is a rear lower left perspective view of the device of FIG. 1.

For the switch lock 20 to operate a rocker-type switch having a rocker element 86 with panels 88, 90 which may be depressed by engaging free ends 92, 94, respectively, as shown in FIG. 4, it is necessary to add rocker switch cams 200 as is shown in FIGS. 2, 6 and 7. The cams 200 are symmetrical about a center line 202 having mounting apertures 204 thereat. The mounting apertures 204 receive pivot pins 206 therein when the cams 200 are positioned in the slots 102, one adjacent each marginal edge of central aperture 100. The cams 200 are generally widest along center line 202 and the rear face 208 tapers from its widest point at center line 202 to each of the ends 210, 212. As a result the rear faces 208 of the cams 200 only contact the panels 88, 90 near their respective free ends 92, 94 which is all that is necessary to operate rocker 86. The front face 214 tapers from its widest point at the center line 202 to a lesser width adjacent ends 210, 212. A generally triangular lobe 216 is positioned adjacent front face 214 at end 210 and a similar lobe 218 is positioned adjacent front face 214 at end 212.

As shown in FIG. 2, the switch lock 20 is able to be positioned on a toggle-type switch or a rocker-type switch without adding or removing any of the structure of the switch lock 20. When positioned over a toggle-type switch, the toggle handle 72 will be operated by the toggle switch cams 128 and 138 (see FIG. 7) and the rocker switch cams 200 will not effect the toggle-type switch operation. Alternatively when switch lock 20 is placed over a rocker-type switch the toggle switch cams 128, 138 will not be operative and the rocker-type switch will be operated by rocker switch cams 200.

Figure 12:
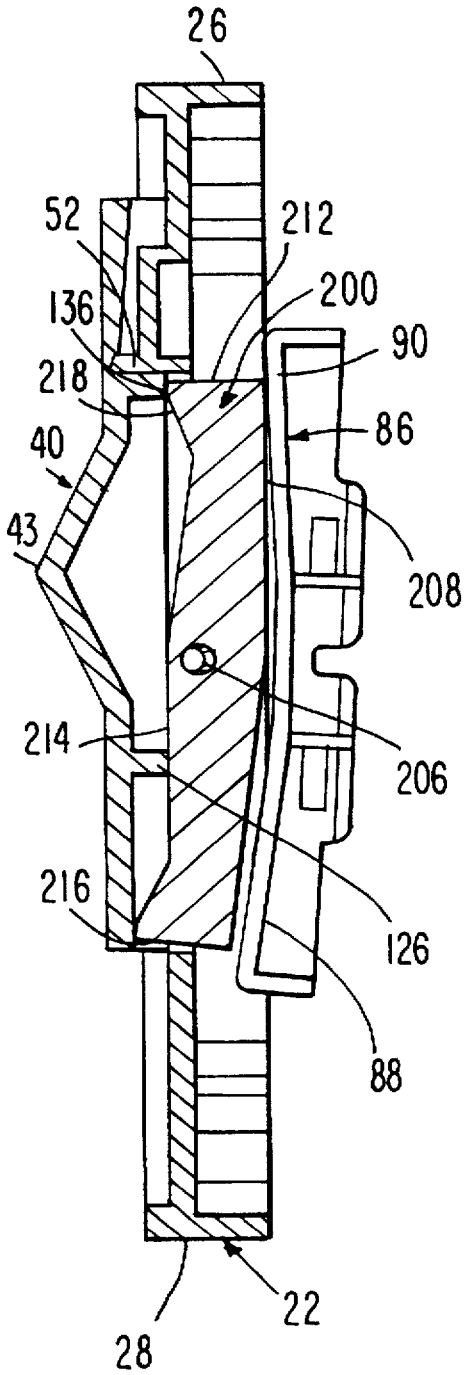
FIG. 12 is a side elevational view, partly in section, of the device of FIG. 1 taken along the lines 12—12 and showing the rocker and the slide in the "on" position.
Figure 13:
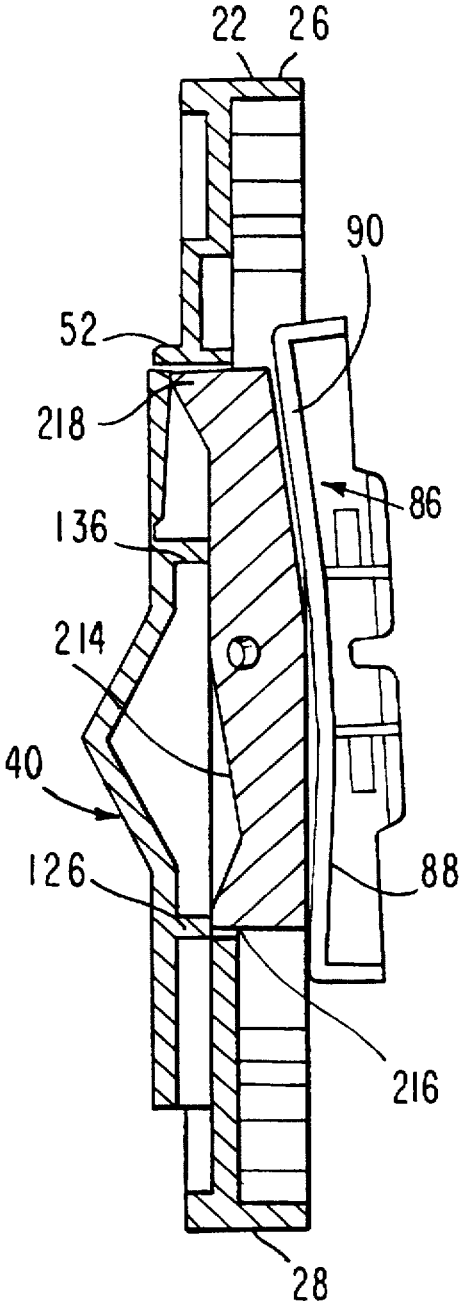
FIG. 13 is the same as FIG. 12, but with the rocker and slide in the "off" position.

FIGS. 12 and 13 show the operation of the switch lock 20 with a rocker-type switch. FIG. 12 shows the rocker switch in the on position. After the stopping tabs 50, 52 have been depressed and the slide member 40 is moved towards top wall 26, the front cam actuator 136 will travel along a portion of the front faces 214 of cams 200 until it engages lobes 218. The movement of front cam actuator 136 over lobes 218 will cause cams 200 to rotate clockwise and rear faces 208 adjacent end 212 will contact panel 90 and depress it to put the rocker-type switch in the on position. When slide member 40 is moved towards bottom wall 28, the rear cam actuator 126 moves along a portion of front face 214 until it engages the lobe 216 adjacent end 210. The rear cam actuator 126 causes the cams 200 to rotate in a counter-clockwise direction which causes rear faces 208 adjacent end 210 to contact panel 88 and depress it to put the rocker-type switch in the off position, as shown in FIG. 13.

While there have been shown and described and pointed out the fundamental novel features of the invention as applied to the preferred embodiment, as is presently contemplated for carrying it out, it will be understood that various omissions and substitutions and changes of the form and details of the device illustrated and in its operation may be made by those skilled in the art, without departing from the spirit of the invention.

I claim:

1. A child resistant switch lock to restrict a child from operating a switch over which said switch lock is applied comprising:

a) a lock body having a body panel, said body panel having a front face and a rear face, said lock body further having a top wall, a bottom wall and two parallel, spaced apart side walls, said top wall, said bottom wall and said two side walls are joined to said rear face of said body panel to form a five-sided enclosure open at the rear face;

b) a slide member mounted upon said lock body and able to move between a first position adjacent said bottom wall and a second position adjacent said top wall, said slide member having a front face and a rear face;

c) said slide member having operating means to operate said switch, over which said switch lock is placed, between on and off conditions; and d) selectively positionable stop means on said lock body having a first position engaging said slide member front face when said slide member is in said first position to prevent said slide member being moved to said second position and said stop means having a second position to permit said slide member to be moved to said second position, whereby when said selectively positionable stop means is in said first position, said slide means is also held in said first position and said switch over which said switch lock is applied is held in its off condition and when said selectively positionable stop means is in said second position, said slide means is able to be moved to said second position and said switch over which said switch lock is applied is moved to its on condition.

2. A child resistant switch lock as defined in claim 1, wherein said selectively positionable means are moved to said second position by depressing them below a leading edge of said slide member.

3. A child resistant switch lock as defined in claim 1, further comprising:

a) two parallel, spaced apart slots in said body panel parallel with said side walls; and b) two depending legs on said slide member each aligned with and engaging a separate one of said slots to limit the travel of said slide member between said first position and said second position.

4. A child resistant switch lock as defined in claim 1, wherein said lock body panel has at least two apertures extending between said front face and said rear face to permit said switch lock to be mounted to said switch.

5. A child resistant switch lock as defined in claim 4, further comprising:

a) a pair of parallel, spaced apart slots, parallel with and spaced inwardly of said side walls of said body panel in said body panel;

b) a pair of rocker cams, one for each of said slots in said body panel;

c) pivotal mounting means on said body panel to mount each of said rocker cams in one of said slots in said body panel and permit said rocker cams to rock in its associated slot in said body panel in response to said operating means of said slide member to operate a rocker switch over which said switch lock is placed, between on and off conditions.

6. A child resistant switch lock as defined in claim 5, wherein said selectively positionable means are moved to said second position by depressing them below a leading edge of said slide member.

7. A child resistant switch lock as defined in claim 1, wherein said lock body panel has at least four apertures extending between said front face and said rear face and said apertures are arranged in pairs along a central longitudinal axis, each member of said pair being spaced an equal distance from a central transverse axis, one to each side of said central transverse axis to permit said switch lock to be mounted to different types of switches.

8. A child resistant switch lock as defined in claim 7, further comprising:

a) a pair of parallel, spaced apart slots, parallel with and spaced inwardly of said side walls of said body panel in said body panel;

b) a pair of rocker cams, one for each of said slots in said body panel;

c) pivotal mounting means on said body panel to mount each of said rocker cams in one of said slots in said body panel and permit said rocker cams to rock in its associated slot in said body panel in response to said operating means of said slide member to operate a rocker switch over which said switch lock is placed, between on and off conditions.

9. A child resistant switch lock as defined in claim 8, wherein said selectively positionable means are moved to said second position by depressing them below a leading edge of said slide member.

10. A child resistant switch lock as defined in claim 1, further comprising:

a) a pair of parallel, spaced apart slots, parallel with and spaced inwardly of said side walls of said body panel in said body panel;

b) a pair of rocker cams, one for each of said slots in said body panel;

c) pivotal mounting means on said body panel to mount each of said rocker cams in one of said slots in said body panel and permit said rocker cams to rock in its associated slot in said body panel in response to said operating means of said slide member to operate a rocker switch over which said switch lock is placed, between on and off conditions.

11. A child resistant switch lock as defined in claim 10, wherein said selectively positionable means are moved to said second position by depressing them below a leading edge of said slide member.

12. A child resistant switch lock as defined in claim 10, further comprising:

a) two parallel, spaced apart slots in said body panel parallel with said side walls; and b) two depending legs on said slide member each aligned with and engaging a separate one of said slots to limit the travel of said slide member between said first position and said second position.

13. A child resistant switch lock as defined in claim 1, wherein said body panel further comprises:

a) a central opening from said front face to said rear face, said central opening permitting the toggle handle of a toggle-type switch to pass through said body panel;

b) said slide member further comprises:

a raised central portion; and a cavity in said central portion to receive the toggle handle of a toggle-type switch after said toggle handle passes through said central opening in said body panel when said switch lock is placed over a toggle-type switch;

c) said operating means of said slide member comprising cam means adjacent said cavity to operate said toggle handle to operate said switch between an on and an off condition.

14. A child resistant switch lock as defined in claim 13, wherein said selectively positionable means are moved to said second position by depressing them below a leading edge of said slide member.

15. A child resistant switch lock as defined in claim 13, wherein said lock body panel has at least two apertures extending between said front face and said rear face to permit said switch lock to be mounted to said switch.

16. A child resistant switch lock as defined in claim 15, wherein said selectively positionable means are moved to said second position by depressing them below a leading edge of said slide member.

17. A child resistant switch lock as defined in claim 13, wherein said lock body panel has at least four apertures extending between said front face and said rear face and said apertures are arranged in pairs along a central longitudinal axis, each member of said pair being spaced an equal distance from a central transverse axis, one to each side of said central transverse axis to permit said switch lock to be mounted to different types of switches.

18. A child resistant switch lock as defined in claim 17, wherein said selectively positionable means are moved to said second position by depressing them below a leading edge of said slide member.

* * * * *